US009413100B2

(12) United States Patent
Gerullis

(10) Patent No.: US 9,413,100 B2
(45) Date of Patent: Aug. 9, 2016

(54) PLUG CONNECTOR AND METHOD FOR ASSEMBLING A PLUG CONNECTOR

(71) Applicant: PHOENIX CONTACT GMBH & CO. KG, Blomberg (DE)

(72) Inventor: Jens Gerullis, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/384,705

(22) PCT Filed: Mar. 14, 2013

(86) PCT No.: PCT/EP2013/000768
§ 371 (c)(1),
(2) Date: Sep. 12, 2014

(87) PCT Pub. No.: WO2013/135385
PCT Pub. Date: Sep. 19, 2013

(65) Prior Publication Data
US 2015/0064963 A1 Mar. 5, 2015

(30) Foreign Application Priority Data
Mar. 15, 2012 (DE) ..... 10 2012 102 188

(51) Int. Cl.
*H01R 13/52* (2006.01)
*H01R 43/18* (2006.01)
*H01R 13/506* (2006.01)

(52) U.S. Cl.
CPC ..... *H01R 13/5213* (2013.01); *H01R 13/506* (2013.01); *H01R 43/18* (2013.01); *Y10T 29/49208* (2015.01)

(58) Field of Classification Search
CPC .... H01R 13/639; H01R 13/447; H01R 24/64; H01R 13/4538; H01R 13/5213; H01R 13/6271; H01R 13/4532; H01R 24/62
USPC ..... 439/521
See application file for complete search history.

(56) References Cited

U.S. PATENT DOCUMENTS

| | | | | |
|---|---|---|---|---|
| 4,342,493 | A | 8/1982 | Grenell | |
| 5,098,315 | A | 3/1992 | Scowen | |
| 5,634,802 | A * | 6/1997 | Kerklaan | 439/131 |
| 5,679,013 | A * | 10/1997 | Matsunaga et al. | 439/144 |
| 6,142,834 | A * | 11/2000 | Liao | 439/676 |
| 6,155,882 | A * | 12/2000 | Wu | 439/676 |
| 6,190,186 | B1 * | 2/2001 | Liao | 439/144 |
| 6,193,522 | B1 * | 2/2001 | Liao | 439/31 |
| 6,564,427 | B1 | 5/2003 | Flegel | |

(Continued)

FOREIGN PATENT DOCUMENTS

| | | | |
|---|---|---|---|
| DE | 102005026715 | B3 | 9/2006 |
| DE | 102010061384 | A1 | 7/2011 |
| JP | 2011249100 | A | 12/2011 |

*Primary Examiner* — Jean F Duverne
(74) *Attorney, Agent, or Firm* — Leydig, Voit & Mayer, Ltd.

(57) ABSTRACT

A plug connector includes a housing formed of a plastics material, where the housing includes a lower housing part. A cover for closing the lower housing part is pivotally arranged on the lower housing part. A receiving element is arranged on the lower housing part and a retainer is arranged on the receiving element. The retainer comprises a bearing on to which the cover is pivotally mounted and a spring element arranged on the retainer which is attached to the cover and the receiving element.

10 Claims, 5 Drawing Sheets

(56) References Cited

U.S. PATENT DOCUMENTS 6,971,921 B1 * 12/2005 Lai ..... 439/676
7,950,936 B2 * 5/2011 Wang et al. ..... 439/144
8,888,516 B2 * 11/2014 Yu et al. ..... 439/144
8,986,023 B2 * 3/2015 Lee et al. ..... 439/138
2010/0227486 A1 9/2010 Lin et al.
2013/0072042 A1 * 3/2013 Liao ..... 439/142

* cited by examiner

PLUG CONNECTOR AND METHOD FOR ASSEMBLING A PLUG CONNECTOR

CROSS-REFERENCE TO RELATED APPLICATIONS

This application is a U.S. National Phase application under 35 U.S.C. §371 of International Application No. PCT/EP2013/000768, filed on Mar. 14, 2013, and claims benefit to German Patent Application No. DE 10 2012 102 188.0, filed on Mar. 15, 2012. The International Application was published in German on Sep. 19, 2013, as WO 2013 135385 A1 under PCT Article 21 (2).

FIELD

The invention relates to a connector comprising a housing formed of a plastics material, the housing having a lower housing part and a cover for closing the lower housing part, the cover being pivotally arranged on the lower housing part. The invention further relates to a method for assembling a connector, in which a cover of a housing formed of a plastics material is mounted on a lower housing part of the housing, the cover being pivotally arranged on the lower housing part when assembled.

BACKGROUND

Connectors, in particular heavy duty connectors, typically have a two-part housing consisting substantially of a lower housing part and a cover. In most cases, a contact element having a plug face is arranged in the lower housing part, the plug face being covered or hidden by the cover when the contact element is not connected to a mating contact element, in that the cover rests on the lower housing part and the housing is closed thereby. It is known in this case that the cover is attached to the lower housing part by means of a retainer. The retainer is typically attached to the lower housing part by means of screws. In order to be able to produce such a screw connection, corresponding threads have to be provided in the housing, in particular in the lower housing part of the housing. This entails additional effort which complicates the production of such connectors. However, if the housing of the connector is formed of a metal (as is typically provided), such a design is not a problem, since the metal that is used provides sufficient strength and thus the metal housing can reliably support the thread. However, it is difficult to also use such a design in housings formed of a plastics material, since plastics material is softer than metal and thus sufficient strength to allow the thread to securely attach the retainer for the cover to the lower housing part in the long term, also at higher ambient temperatures, can only be provided with difficulty.

SUMMARY

In an embodiment, the present invention provides a plug connector including a housing formed of a plastics material, where the housing includes a lower housing part. A cover for closing the lower housing part is pivotally arranged on the lower housing part. A receiving element is arranged on the lower housing part and a retainer is arranged on the receiving element. The retainer comprises a bearing on to which the cover is pivotally mounted and a spring element arranged on the retainer which is attached to the cover and the receiving element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
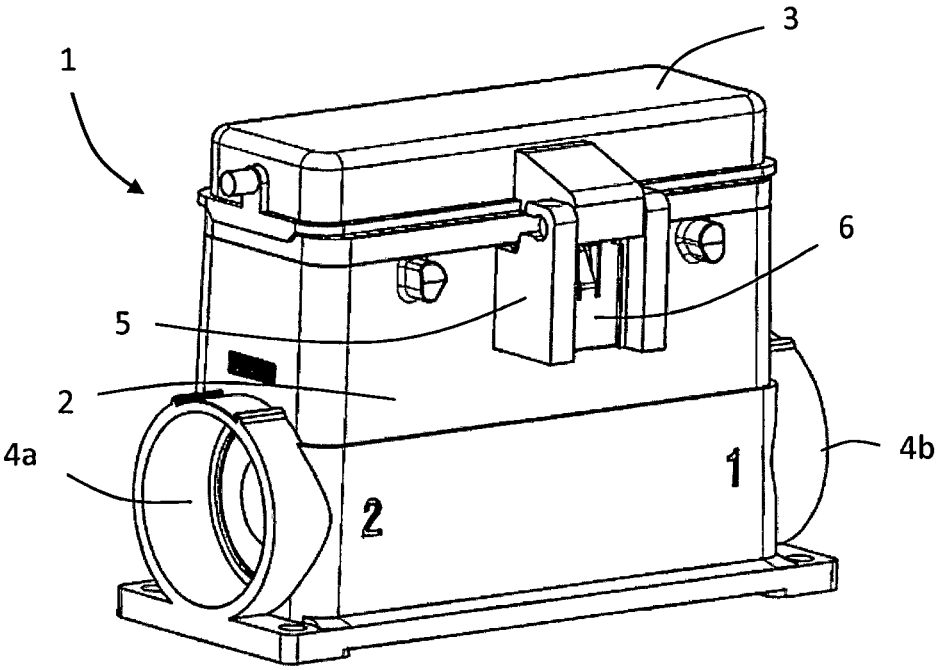
FIG. 1 is a schematic view of a connector according to the invention.

An aspect of the present invention is to provide a connector and a method for assembling a connector, by means of which, with a connector housing formed of a plastics material, secure attachment of a cover of the housing to a lower housing part of the housing can be ensured in the long term, even with high stresses, in particular increased temperature load, and at the same time the attachment can be created in a simple manner in terms of production.

In one embodiment, in order to pivotally arrange the cover on the lower housing part, a receiving element is arranged on the lower housing part, a retainer is arranged on the receiving element, which retainer has a bearing on which the cover is pivotally mounted, and a spring element is arranged on the retainer, which spring element is attached to the cover and to the receiving element.

In a method for assembling a connector of the type described in more detail at the outset, the following steps are provided: forming a receiving element on the lower housing part, arranging a retainer on the receiving element, arranging a cover on a bearing formed on the retainer, and arranging a spring element on the retainer, the spring element being attached to the cover and to the receiving element.

The attachment of a cover to a lower housing part of a housing of a connector is characterised in that said attachment can now take place without screws and thus the durability and load capacity of the attachment of a cover to a lower housing part can be significantly improved with respect to conventional screw attachments to a plastics housing. The cover is substantially attached to the lower housing part via a receiving element, a retainer and a spring element. The receiving element is preferably arranged, in particular moulded, on an outer side of the housing, and preferably has a block-like shape, in particular a substantially rectangular block-like shape, so that the receiving element protrudes from the outer side of the housing. The receiving element allows for screwless attachment of the retainer to the lower housing part, in that the retainer can be pushed, or also for example clipped, onto the receiving element attached to the lower housing part. If the retainer is arranged on the receiving element, the cover is arranged on a bearing formed on the retainer. The bearing is preferably formed by retaining elements having rounded recesses, into which bearing journals formed on the cover can be latched such that the bearing journals are rotatably mounted within the rounded recesses. Finally, a spring element is arranged on the retainer such that it is attached to both the receiving element and the cover, whereby the retainer is fixed to the receiving element, and at the same time this means that the cover can be held in an open position and in a closed position by means of the spring element. In the closed position, the cover, which is rotatably or pivotally mounted on the retainer, rests on the lower housing part so that the plug face of the contact element arranged in the lower housing part is covered, and in the open position the cover is pivoted away from the lower housing part. In order to attach the spring element, it is pushed onto the retainer, in that the spring element is displaced along an outer surface of the retainer and comes to abut said retainer in the desired position. The spring element thus brings about an interlocking connection of the cover to the lower housing part.

According to a preferred embodiment of the invention, the spring element is plate-shaped and comprises at least two spring arms, a first spring arm being attached to the cover and a second spring arm being attached to the receiving element. Good spring action and at the same time secure connection of the spring element and thus also of the retainer to the receiving element and the lower housing part, respectively, can be achieved by means of the two spring arms of the plate-shaped spring element. The plate-shaped design of the spring element allows for a particularly compact arrangement thereof, said spring element preferably having a relatively low thickness and abutting the retainer as tightly as possible when assembled. The two spring arms are preferably formed on a base body of the spring element. The second spring arm is preferably moulded or cut out from the base body, in that the second spring arm is formed as a tab bent at an angle to the base body and also to the first spring arm, which is preferably formed as an extension of the base body, and a type of window is formed thereby in the base body, which window extends as far as into the first spring arm.

In order to attach the spring element to the cover, it is preferably provided that the first spring arm abuts a stop, formed on the retainer, such that the cover is held in position by the spring force of the first spring arm. The cover preferably has a recess into which the first spring arm of the spring element is inserted, the recess having a stop at its closed end within the cover. In this case, the first spring arm is preferably inserted so far into the recess that the free end of the first spring arm abuts the stop. As a result, targeted guidance of the cover during a pivot movement of the cover and targeted fixing of the cover in the desired position relative to the lower housing part are possible using simple means and with a simple design.

In order to attach the spring element, it is further preferred that the second spring arm is latched behind a rear engagement portion formed on the receiving element. In this case, the second spring arm is preferably formed to be flexible such that it is bent towards the rear engagement portion when the spring element is pushed onto the retainer, and such that it is guided in such a way that the free end of the second spring arm can latch on or engage behind the rear engagement portion. This allows for the provision of a secure, interlocking connection between the cover and the lower housing part by means of the spring element, the retainer and the receiving element with a simple design and low assembly time.

The spring element is preferably formed of a metal, it being possible to achieve particularly good spring action, high load capacity and long service life as a result. Here, the spring element is preferably formed of a sheet material.

A further preferred embodiment of the invention provides that the receiving element comprises a dovetail guide for arranging the retainer in the receiving element. By providing a dovetail guide on the receiving element, the retainer can be securely pushed onto the receiving element in a simple manner, in that an interlocking connection is formed between the receiving element and the retainer, said connection being similar to a tongue and groove connection, by means of the dovetail guide and an engagement element, which is formed such as to correspond to the retainer and is guided in the dovetail guide. The dovetail guide allows not only transverse forces, but also tensile forces, to be transferred to the receiving element when the retainer is attached. In addition, this connection of the retainer to the receiving element allows the retainer to be arranged as tightly as possible on the receiving element, so that they can be positioned relative to one another in a compact manner in the connector. The dovetail guide comprises one or more trapezoidal slots, into which trapezoidal or dovetailed engagement elements can engage and can be guided, which engagement elements are in the form of webs that form the tongue and groove connection, whereby a frictional connection is created in addition to the interlocking connection. However, it is also alternatively possible for a guide which is formed in a different manner to a dovetail guide to be provided on the receiving element for attaching the retainer to the receiving element.

It is preferably further provided that the receiving element is formed integrally with the lower housing part. In this case, the receiving element is preferably produced together with the lower housing part in an injection moulding process in order to achieve the integral connection between the receiving element and the lower housing part. The integral design in the injection moulding process allows for the production complexity and production time to be reduced and in addition, particularly secure attachment of the receiving element to the lower housing part can be achieved. However, it is also possible for the receiving element to be formed as a separate component from the lower housing part that can be attached, for example attached via a latch connection, to the lower housing part, in particular to an outer side of the lower housing part.

In addition, it is preferably provided that the retainer is pushed onto the receiving element and the retainer has a stop for limiting the path of the retainer when said retainer is pushed onto the receiving element. By means of the stop, it can be prevented that the retainer is pushed too far over the receiving element, as a result of which it would not be possible to ensure secure attachment of the retainer to the receiving element. The stop is preferably formed on the housing as a rib which is formed transverse to the direction in which the retainer is pushed onto the receiving element, and which hits a lower side face, which extends transversely, of the receiving element when the retainer is pushed onto the receiving element.

FIG. 1 shows a connector according to the invention in a final assembled state. The connector comprises a housing 1 formed of a plastics material, the housing 1 comprising a lower housing part 2 and a cover 3. The lower housing part 2 shown here comprises two cable insertion openings 4*a*, 4*b* for inserting a cable in each case into the lower housing part 2 of the housing 1, the inserted cable being connected to a contact element arranged in the lower housing part 2. In turn, the contact element comprises a plug face, to which a mating contact element can be connected. If a mating contact element is not connected to the plug face, the plug face can be covered by the cover 3, in that the cover 3 is brought to rest on the lower housing part 2 via a pivot movement of the cover 3, as shown in FIG. 1, and the housing 1 being closed thereby. As a result, the contact element arranged in the lower housing part 2 and in particular the plug face of the contact element can be protected from dirt and moisture. In this case, the cover 3 is pivotally arranged on the lower housing part 2 so that the housing 1 and in particular the lower housing part 2 can be closed and opened via a simple pivot movement of the cover 3, without the cover 3 having to be completely removed from the lower housing part 2. Here, the cover 3 is attached to the lower housing part 2 without using screws. In order to attach the cover 3 to the lower housing part 2, in particular a receiving element 7, a retainer 5 and a spring element 6 are provided, as shown in FIG. 2.

The attachment of the cover 3 to the lower housing part 2 is shown in detail in FIG. 2 to 9.

Figure 2:
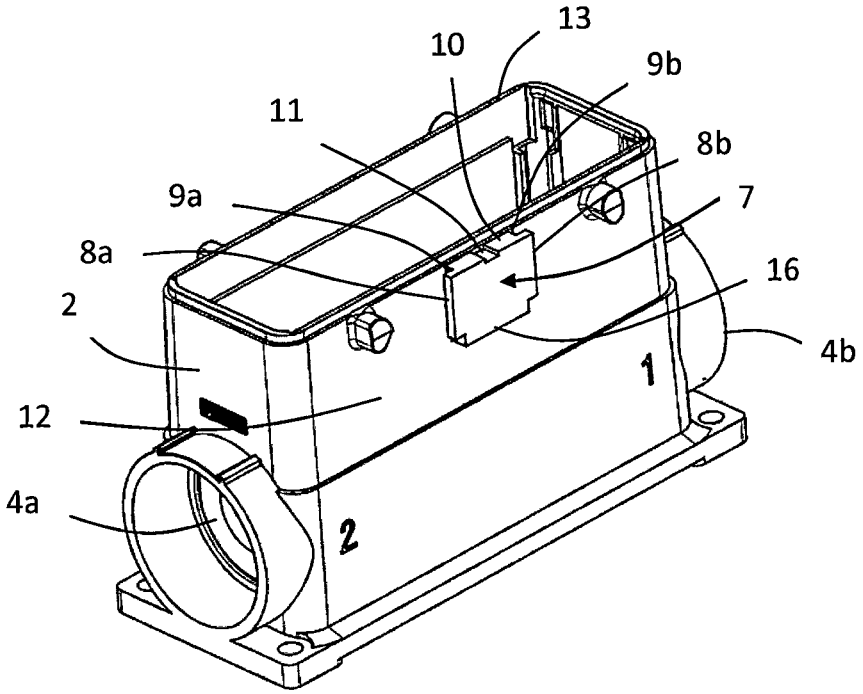
FIG. 2 is a schematic view of a lower housing part of a housing of the connector according to the invention having a receiving element arranged thereon.

FIG. 2 shows the lower housing part 2 having a receiving element 7 arranged on an outer side of the lower housing part 2. The receiving element 7 is likewise formed of a plastics material and is preferably formed together with the lower housing part 2 in an injection moulding process of the lower housing part 2, so that the receiving element 7 is formed integrally with the lower housing part 2 in one operation. The receiving element 7 is substantially formed as a narrow, substantially rectangular block, a dovetail guide being formed on the receiving element 7 in that a trapezoidal slot 9*a*, 9*b* is formed on each of the two longitudinal side faces 8*a*, 8*b* of the receiving element 7 for receiving and attaching the retainer 5. A rear engagement portion 11 in the form of a slit-like recess is additionally formed on one transverse side 10, which points towards the cover 3, of the receiving element 7, in which recess the spring element 6 can hook or latch and thus be attached to the receiving element 7. The receiving element 7 is arranged in the middle along a longitudinal side face 12 of the lower housing part 2 and such as to be adjacent to, preferably such as to terminate flush with, an upper rim 13 of the lower housing part 2, on which the cover 3 rests when in a closed state or the closed position.

Figure 3:
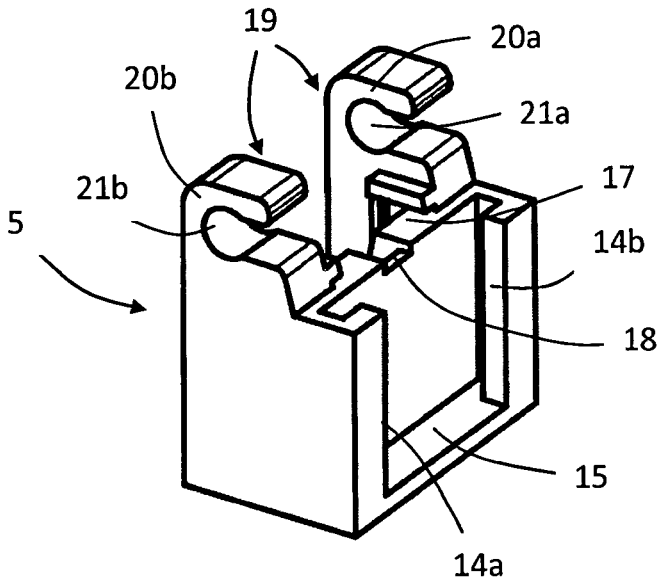
FIG. 3 is a schematic view of a retainer of the connector according to the invention.
Figure 4:
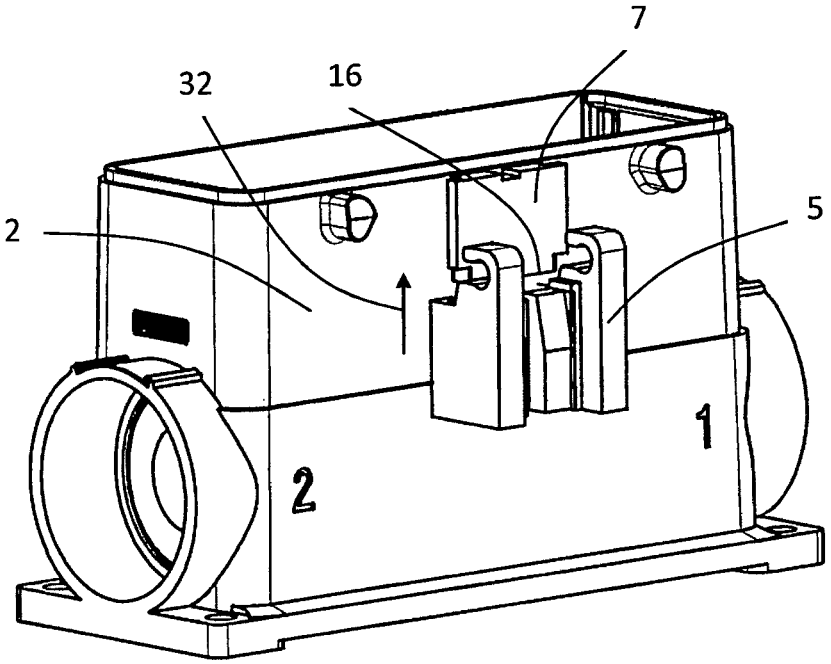
FIG. 4 is a schematic view of a process for attaching the retainer to the receiving element arranged on the lower housing part of the connector according to the invention.
Figure 5:
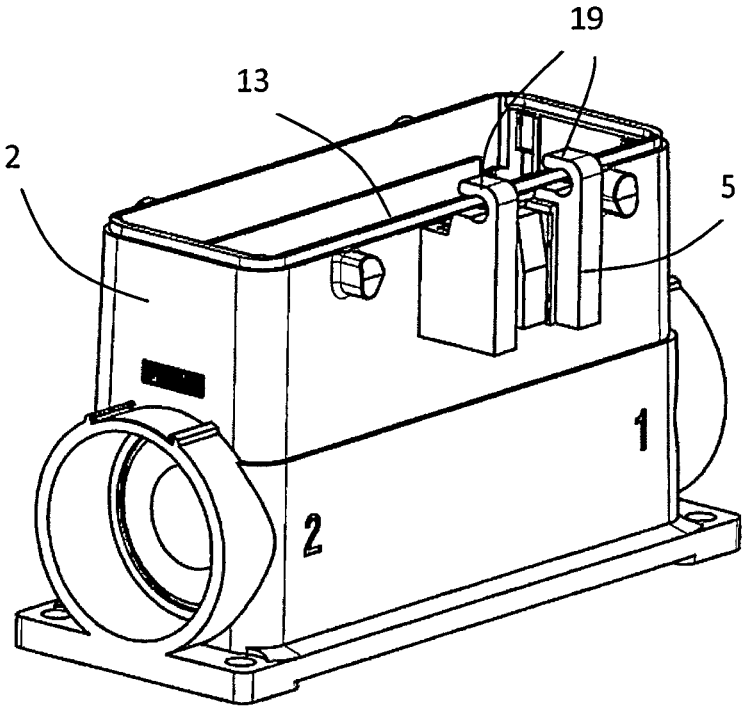
FIG. 5 is a schematic view of the retainer, according to the invention, arranged on the receiving element.
Figure 6:
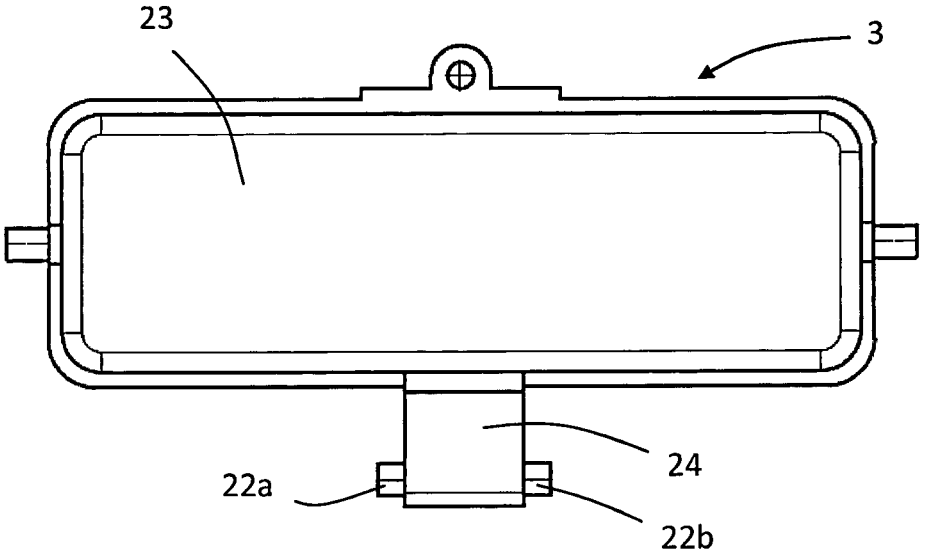
FIG. 6 is a schematic view of a cover of a housing of the connector according to the invention.
Figure 8:
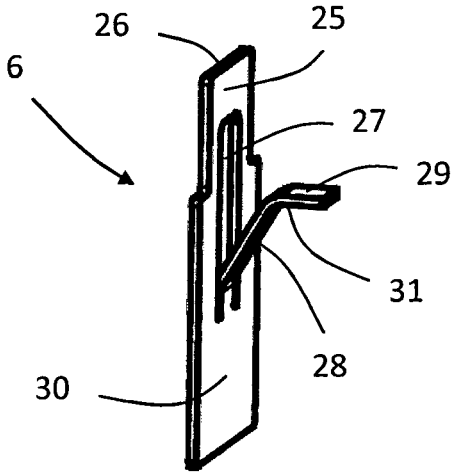
FIG. 8 is a schematic view of a spring element of the connector according to the invention.

As shown in FIG. 3, a retainer 5 is arranged on the receiving element 7 in that the retainer 5 is pushed onto the receiving element 7 from below in the direction of the arrow 32, as shown in FIG. 4. The retainer 5 comprises a first region for attaching and guiding the retainer 5 on the receiving element 7, a second region for attaching the spring element 6 and a third region for mounting the cover 3. The first region comprises two opposing engagement elements 14*a*, 14*b* which extend on the longitudinal side and are in the form of webs which engage in the trapezoidal slots 9*a*, 9*b* formed on the receiving element 7, so that the retainer 5 can be pushed onto the receiving element 7. At the first region, the receiving element 7 also comprises a stop 15 which is arranged transverse to the engagement elements 14*a*, 14*b* and is in the form of a rib which hits a lower transverse side face 16 or a lower side face, which extends transversely, of the receiving element 7 when the retainer 5 is pushed far enough onto the receiving element 7, as shown in FIG. 4. The second region of the retainer 5 is formed opposite the first region of the retainer 5 and is used to allow the spring element 6 to be pushed onto the retainer 5, the retainer 5 being fixed to the receiving element 7 by means of the spring element 6. On an upper transverse side 17 of the retainer 5, which side points towards the cover 3 when assembled, the second region comprises a groove 18, via which a part of the spring element 6, in particular a second spring arm 31 of the spring element 6, can be pushed into the rear engagement portion 11 formed on the receiving element 7 and attached here, as shown in FIG. 8. This groove 18 of the retainer 5 is thus formed as an extension to the rear engagement portion 11 of the receiving element 7. The third region of the retainer 5 is arranged above the second region and comprises a bearing 19, in which the cover 3 can be arranged. The bearing 19 comprises two retaining elements 20*a*, 20*b* which are arranged spaced apart from one another and each comprise a slot-like, circular opening 21*a*, 21*b*, in which bearing journals 22*a*, 22*b* formed on the cover 3 can engage and be rotatably mounted, as shown in FIG. 6. As shown in FIG. 5, the retainer 5 is pushed so far onto the receiving element 7 that the bearing 19 projects upwards beyond the upper rim 13 of the lower housing part 2.

Figure 7:
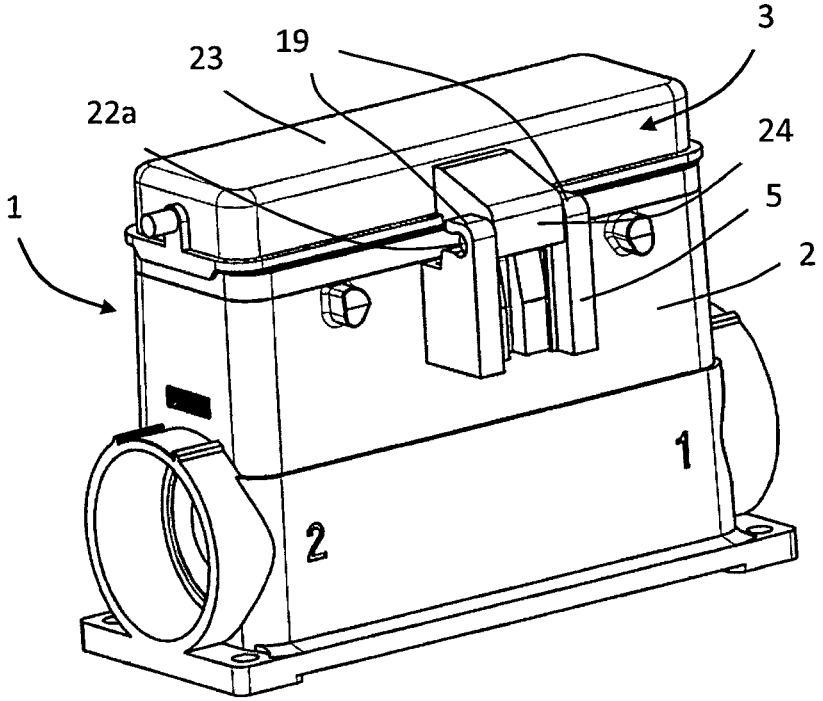
FIG. 7 is a schematic view of the arrangement of the cover on the retainer, according to the invention, arranged on the receiving element.

As shown in FIG. 5, as soon as the retainer 5 is arranged on the receiving element 7, the cover 3 is attached to the retainer 5, in particular to the bearing 19 of the retainer 5, as shown in FIG. 7.

FIG. 6 is a plan view of the cover 3, the cover 3 being formed substantially of a cover surface 23, which is arranged on the rim 13 of the lower housing part 2 and thus completely covers a top side of the lower housing part 2 or the plug face of the contact element arranged in the lower housing part 2, a retaining arm 24, which is moulded on the cover surface 23 and projects beyond the cover surface 23 on one side, and two bearing journals 22*a*, 22*b* which are moulded on the retaining arm 24. The bearing journals 22*a*, 22*b* are arranged spaced apart from the cover surface 23 on the cover 3 by means of the retaining arm 24.

Figure 9:
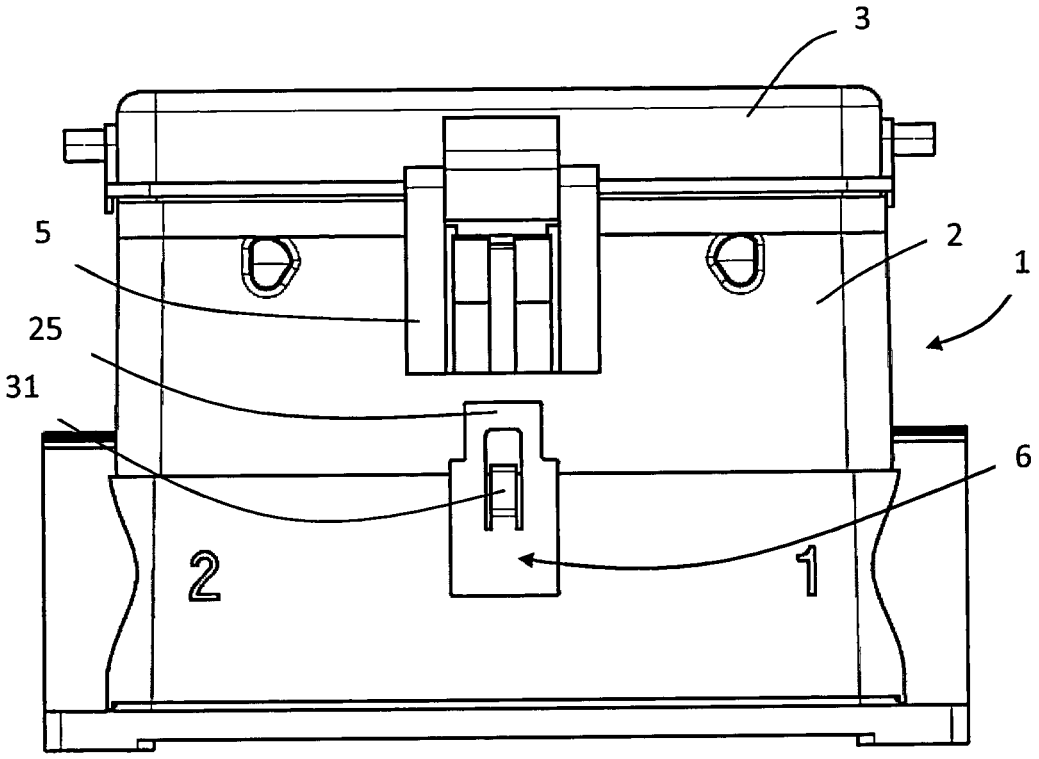
FIG. 9 is a schematic view of a process for attaching the spring element to the retainer and the cover of the connector according to the invention.

As shown in FIG. 9, if the cover 3 is attached to the retainer 5, the spring element 6 is pushed onto the retainer 5.

FIG. 8 is an enlarged view of the spring element 6. The spring element 6 is formed of a metal, in particular of a sheet, and is substantially plate-shaped, i.e. in the form of a thin plate. The spring element 6 comprises a base body 30, on which a first spring arm 25 and a second spring arm 31 are formed. The first spring arm 25 is formed on a top side of the spring element 6, so that the first spring arm 25 forms an extension of the base body 30, and the first spring arm 25 is used to attach the spring element 6 to the cover 3. On its retaining arm 24, the cover 3 preferably comprises a recess into which the first spring arm 25 of the spring element 6 is inserted. At its closed end within the cover 3, the recess comprises a stop, the first spring arm 25 being inserted so far into the recess that the free end, in particular the upper edge 26 of the free end, of the first spring arm 25 abuts the stop. As a result, a spring force can be applied to the cover 3 by the spring element 6, which spring force holds the cover 3 in the open position and in the closed position.

The spring element 6 also comprises a second spring arm 31. This spring arm 31 is produced by forming a window 27 in the spring element 6, in particular in the base body 30 of the spring element 6, a part of the spring element 6 being bent outwards to form the window 27, which part then forms the second spring arm 31. In this case, the window 27 extends along the longitudinal side face of the spring element 6, a portion of the window 27 extending as far as into the first spring arm 25, whereby the spring action of the first spring arm 25 can be improved. The second spring arm 31 is bent outwards towards the receiving element 7 at an angle to the first spring arm 25 and to the base body 30, and is used to attach the spring element 6 to the receiving element 7 and to thus simultaneously fix the retainer 5 to the receiving element 7. The second spring arm 31 is divided into a first portion 28 and a second portion 29, the first portion 28 being formed integrally with the second portion 29. The first portion 28 is integrally connected to the base body 30 and extends at an angle of between 30° and 80° relative to the longitudinal side face of the base body 30. The second portion 29 is shorter than the first portion 28 and is at an angle of substantially 90° to the longitudinal side face of the base body 30. The second portion 29 is the free end of the second spring arm 31, by means of which end the second spring arm 31 is pushed onto the recess 18, formed in the retainer 5, and the rear engagement portion 11, formed on the receiving element 7, and latched here, in order to attach the spring element 6 to the receiving element 7 and to thus simultaneously fix the retainer 5 to the receiving element 7.

FIG. 9 shows how the spring element 6 is pushed onto the retainer 5. For this purpose, the spring element 6 is pushed onto the retainer 5, from below in the direction of the arrow 33, and thus into the cover 3 and the receiving element 7. When the spring element 6 is pushed on, the first spring arm 25 is pushed, as far as up to its stop, into the groove formed in the cover 3 and, when pushed on in the direction of the receiving element 7, the second spring arm 31 is pivoted in order to latch on the rear engagement portion 11 of the receiving element 7.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Housing 1
Lower housing part 2
Cover 3
Cable insertion opening 4*a*, 4*b*
Retainer 5
Spring element 6
Receiving element 7
Longitudinal side face 8*a*, 8*b*
Dovetail guide 9*a*, 9*b*
Transverse side 10
Rear engagement portion 11
Longitudinal side face 12
Rim 13
Engagement element 14*a*, 14*b*
Stop 15
Transverse side face 16
Transverse side 17
Recess 18
Bearing 19
Retaining element 20*a*, 20*b*
Opening 21*a*, 21*b*
Bearing journal 22*a*, 22*b*
Cover surface 23
Retaining arm 24
First spring arm 25
Upper edge 26
Window 27
First portion 28
Second portion 29
Base body 30
Second spring arm 31
Arrow 32
Arrow 33

The invention claimed is:

1. A plug connector comprising:

a housing formed of a plastics material, the housing comprising a lower housing part; and a cover for closing the lower housing part, the cover being pivotally arranged on the lower housing part, wherein a receiving element is arranged on the lower housing part and a retainer is arranged on the receiving element, the retainer comprising a bearing on which the cover is pivotally mounted, and a spring element arranged on the retainer, which is attached to the cover and the receiving element.

2. The plug connector recited in claim 1, wherein the spring element is plate-shaped and comprises at least two spring arms, a first spring arm attached to the cover and a second spring arm attached to the receiving element.

3. The plug connector recited in claim 2, wherein in order to attach the spring element to the cover, the first spring arm abuts a stop, formed on the cover, such that the cover is held in position by the spring force of the first spring arm.

4. The plug connector recited in claim 2, wherein in order to attach the spring element to the receiving element, the second spring arm is latched behind a rear engagement portion formed on the receiving element.

5. The plug connector recited in claim 1, wherein the spring element is formed of as metal.

6. The plug connector recited in claim 1, wherein the receiving element is formed integrally with the lower housing part.

7. The plug connector recited in claim 1, wherein the retainer is pushed onto the receiving element, the retainer comprising a stop for limiting the path of the retainer when said retainer is pushed onto the receiving element.

8. A method for assembling a plug connector, in which a cover of a housing formed of a plastics material is mounted on a lower housing part of the housing, wherein, when assembled, the cover is pivotally arranged on the lower rousing part, said method comprising the steps of:

forming a receiving element on the lower housing part, arranging a retainer on the receiving element, arranging the cover on a bearing formed on the retainer, and arranging a spring element on the retainer, wherein the spring element is attached to the cover and to the receiving element.

9. The method for assembling a plug connector recited in claim 8, wherein the receiving element is formed integrally with the lower housing part in an injection molding process.

10. A plug connector comprising:

a housing formed of a plastics material, the housing comprising a lower housing part; and a cover for closing the lower housing part, the cover being pivotally arranged on the lower housing part, wherein a receiving element is arranged on the lower housing part and a retainer is arranged on the receiving element, the retainer comprising a bearing on which the cover is pivotally mounted, and a spring element arranged on the retainer, which is attached to the cover and the receiving element, and wherein the receiving element comprises a dovetail guide for arranging the retainer on the receiving element.

* * * * *